US007578885B2

(12) United States Patent
Mendenhall et al.

(10) Patent No.: US 7,578,885 B2
(45) Date of Patent: Aug. 25, 2009

(54) CONCRETE/ASPHALT WET WASHING SYSTEM

(76) Inventors: Robert L. Mendenhall, 4420 S. Decatur Blvd., Las Vegas, NV (US) 89103; Gilbert Cabrera, 4420 S. Decatur Blvd., Las Vegas, NV (US) 89103

( * ) Notice: Subject to any disclaimer, the term of this patent is extended or adjusted under 35 U.S.C. 154(b) by 358 days.

(21) Appl. No.: 11/377,975

(22) Filed: Mar. 16, 2006

(65) Prior Publication Data

US 2007/0215176 A1 Sep. 20, 2007

(51) Int. Cl.
*B08B 3/02* (2006.01)
*E01H 1/04* (2006.01)

(52) U.S. Cl. ..... 134/6; 134/34; 15/340.1; 15/340.3; 15/340.4; 15/83

(58) Field of Classification Search ..... 15/83–86, 15/340.1, 340.3, 340.4; 210/189, 195, 196, 210/197, 255, 264, 532.1
See application file for complete search history.

(56) References Cited

U.S. PATENT DOCUMENTS 2,782,435 A * 2/1957 Stone ..... 15/83
2,917,761 A * 12/1959 Burgdorff ..... 15/84
3,802,022 A * 4/1974 Fleming ..... 15/84
4,018,483 A 4/1977 Smith
4,092,249 A * 5/1978 La Gatta ..... 210/195.1
4,457,044 A 7/1984 Erdman et al.
4,561,145 A 12/1985 Latham
4,754,521 A 7/1988 Zoni
4,993,498 A 2/1991 Fresnel
5,006,012 A * 4/1991 Sterner ..... 404/107
6,142,290 A 11/2000 Tagliaferri
6,154,922 A * 12/2000 Vanderlinden ..... 15/346
6,444,046 B1 * 9/2002 Hillbrand ..... 134/34
2003/0204931 A1 * 11/2003 Kim ..... 15/340.3

* cited by examiner

*Primary Examiner*—Michael Barr
*Assistant Examiner*—Saeed T Chaudhry
(74) *Attorney, Agent, or Firm*—Greenberg Traurig

(57) ABSTRACT

A surface cleaning system having a storage container, debris collection apparatus and debris conduit is disclosed. Water discharged from spray nozzles forces debris into a debris collection apparatus such that a series of rotating brushes can transport the debris to an open end of the debris conduit. An auger, water pressure or air pressure is used to force the debris through the debris conduit into the storage container for disposal. The storage container includes a single unit having multiple joined compartments or individual units for separating debris, particulates and water. The design of the debris collection apparatus also facilitates the capture of most of the water used to force the debris into the debris collection apparatus. Accordingly, the system is able to reuse the water thereby extending the surface area that may be cleaned with a specified amount of water.

38 Claims, 9 Drawing Sheets

CONCRETE/ASPHALT WET WASHING SYSTEM

FIELD OF THE INVENTION

The embodiments of the present invention relate to a mobile device for cleaning road and street surfaces. More particularly, the embodiments relate to a mobile, all water configuration, street sweeper and cleaning system and method of using the same.

BACKGROUND

Vehicles configured with street or road cleaning systems are well-known in the prior art. The systems commonly utilize combinations of brushes and water to collect debris and clean a subject road surface. Unfortunately, the prior art systems suffer from drawbacks, including inefficient operation, large water consumption, complex configurations and ineffective results. Often times the prior art systems simply use brushes which tend to move debris from one location to another without collecting the debris and leave large, hazardous pools of water. Additionally, the current systems cause dust to be disseminated throughout a wide area surrounding the cleaning system.

Even though the current street sweeper systems suffer from the aforementioned drawbacks, there is a tremendous need for such sweepers. Accidental and intentional litter, dust from construction projects, landscape remnants and similar debris commonly finds its way onto roads or streets. When on streets, these materials are unsightly and can create a hazard for drivers. In addition, construction sites and the like must abide by environmental regulations requiring a clean work site.

Thus, there is a need for a street sweeper that overcomes the drawbacks of the prior art street sweepers.

SUMMARY

Accordingly, a first apparatus embodiment of the present invention comprises: a storage system; a debris collection apparatus housing a series of brushes; a water pump operable to draw water from the storage system and discharge said water through one or more spray nozzles adjacent to, and directed into, the debris collection apparatus causing said discharged water to force debris into the debris collection apparatus; a debris conduit extending generally from the collection apparatus to the storage container; a drive means operable to rotatably drive the brushes about a horizontal axis such that collected debris and water is forced from the debris collection apparatus into the debris conduit; and one or more water spray nozzles and/or air spray nozzles operable to force the collected debris and water through the debris conduit and into the storage system.

A second apparatus embodiment of the present invention comprises: a storage system; a debris collection apparatus housing a series of rotatable brushes; a water pump operable to draw water from the storage system and discharge said water through one or more spray nozzles adjacent to, and directed into, the debris collection apparatus causing said discharged water to force debris into the debris collection apparatus; a debris conduit extending generally from the collection apparatus to the storage system; a drive means operable to rotatably drive the brushes about a horizontal axis such that collected debris and water is forced from the debris collection apparatus into the debris conduit; and an auger operable to transport the collected debris and water through the debris conduit and into the storage system.

A first method embodiment of the present invention comprises: projecting water against a road surface such that debris is directed into a debris collection apparatus; within the debris collection apparatus, rotating brushes about a horizontal axis in a direction corresponding to a direction of the projected water such that the debris, along with collected water, is forced adjacent to a first open end of a debris conduit wherein the debris conduit extends from the debris collection apparatus to a storage system; and forcing the debris and collected water from the first open end of the debris conduit through the debris conduit and into the storage system.

The street sweeper system of the present invention utilizes high velocity water or air streams to collect and, in some embodiments transport, debris to a storage container or tank. Other embodiments utilize an auger to transport debris to a storage container. In one embodiment, the tank includes three compartments into which the debris and water is collected. As described in more detail below, the compartments are each partially open to one another allowing water and debris to separate and collect into respective compartments.

Other variations, embodiments and features of the present invention will become evident from the following detailed description, drawings and claims.

DETAILED DESCRIPTION

Figure 1:
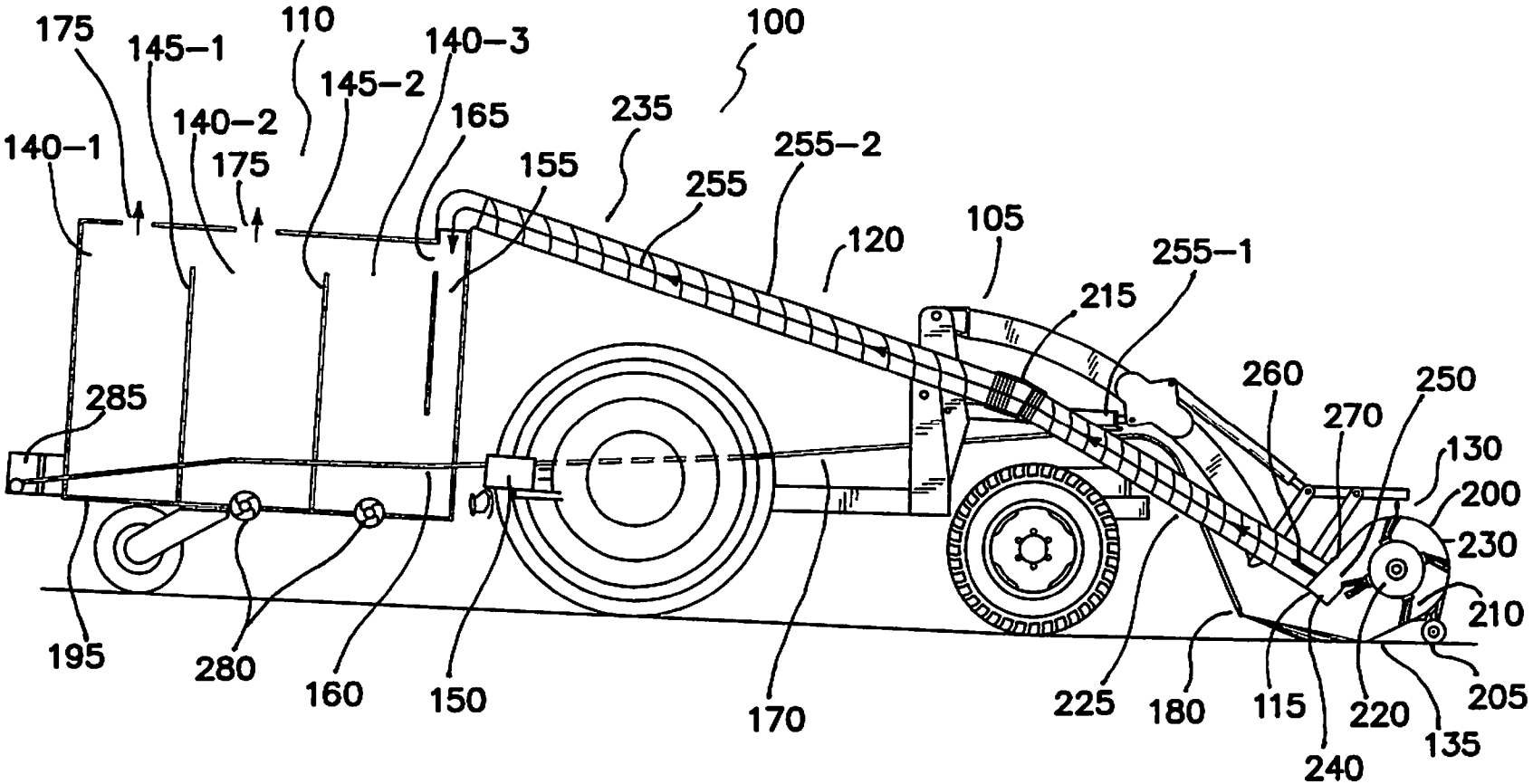
FIG. 1 illustrates a side view of a first embodiment of the present invention installed on a tractor.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

Reference is now made to the figures wherein like parts are referred to by like numerals throughout. FIG. 1 shows a side view of a first embodiment of the present invention wherein the street sweeper system is generally referred to by reference numeral 100. The street sweeper system 100 incorporates three primary components, namely a liquid and debris storage tank 110, debris conduit 120 and debris collection apparatus 130.

The cross-sectional view of the liquid and debris storage tank 110 shows three individual compartments 140-1 through 140-3 partially separated by barriers 145-1 and 145-2. Upper sections of the compartments 140-1 through 140-3 are open to one another. Initially, prior to use, generally clean water or any desired liquid is pumped or otherwise deposited into compartments 140-1 through 140-3 and subsequently used to collect debris. As described in more detail below, compartments 140-1 and 140-2 function to retain debris and dirty water collected during use, while compartment 140-3 is designated for clean water.

Figure 5:
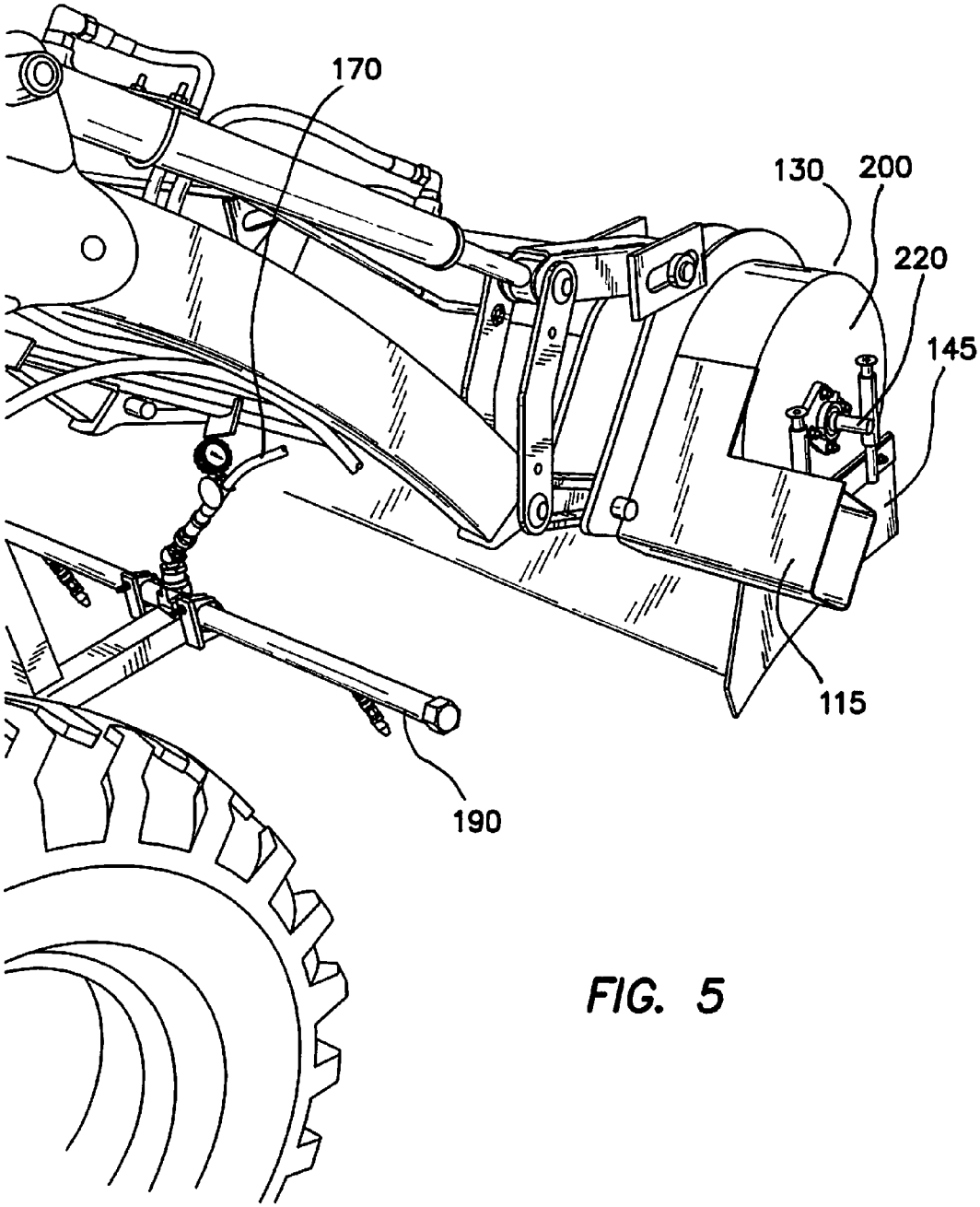
FIG. 5 illustrates a perspective rear view of the debris collection apparatus as arranged in combination with a series of spray nozzles.
Figure 6:
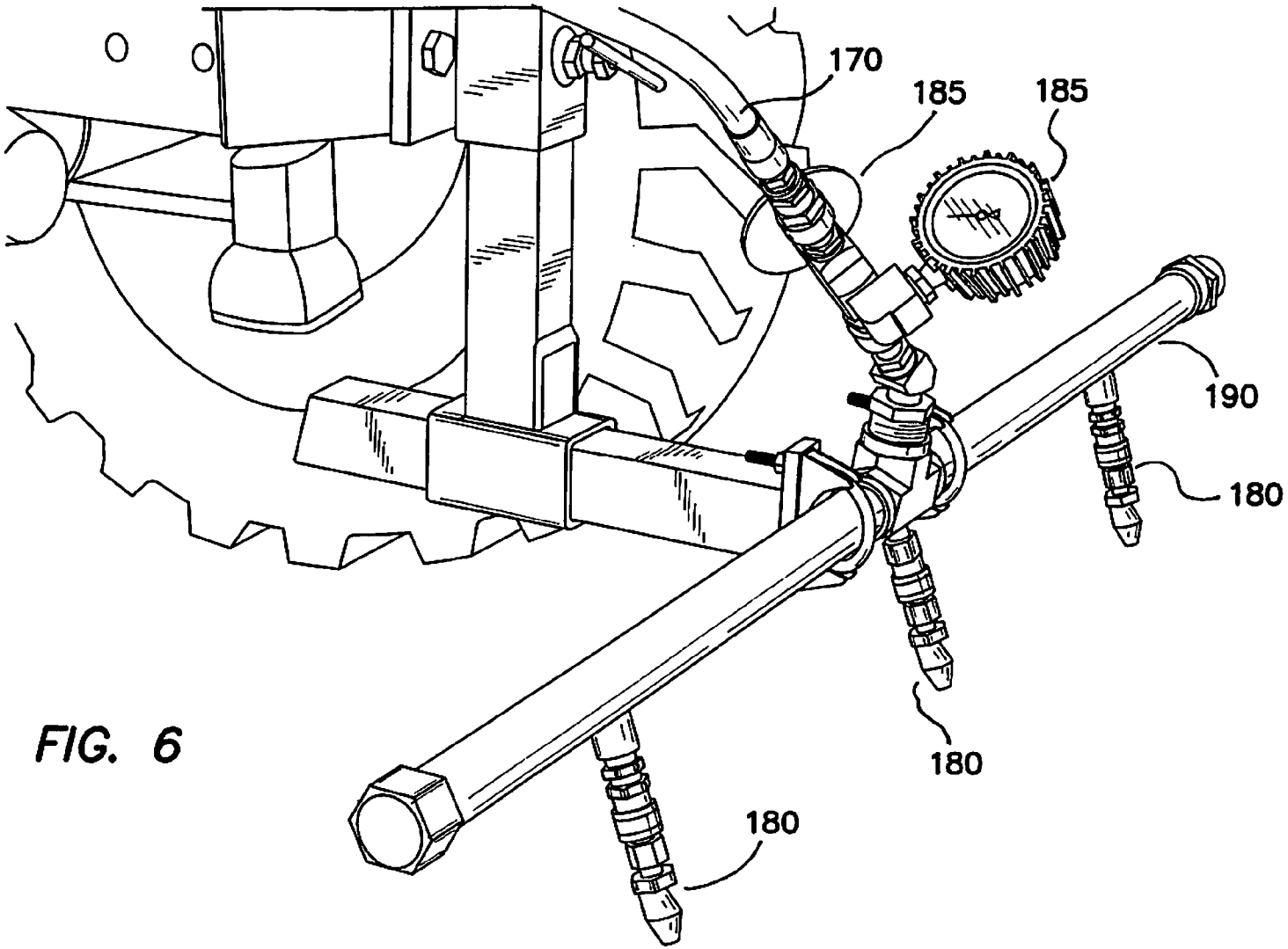
FIG. 6 illustrates the series of spray nozzles.
Figure 7:
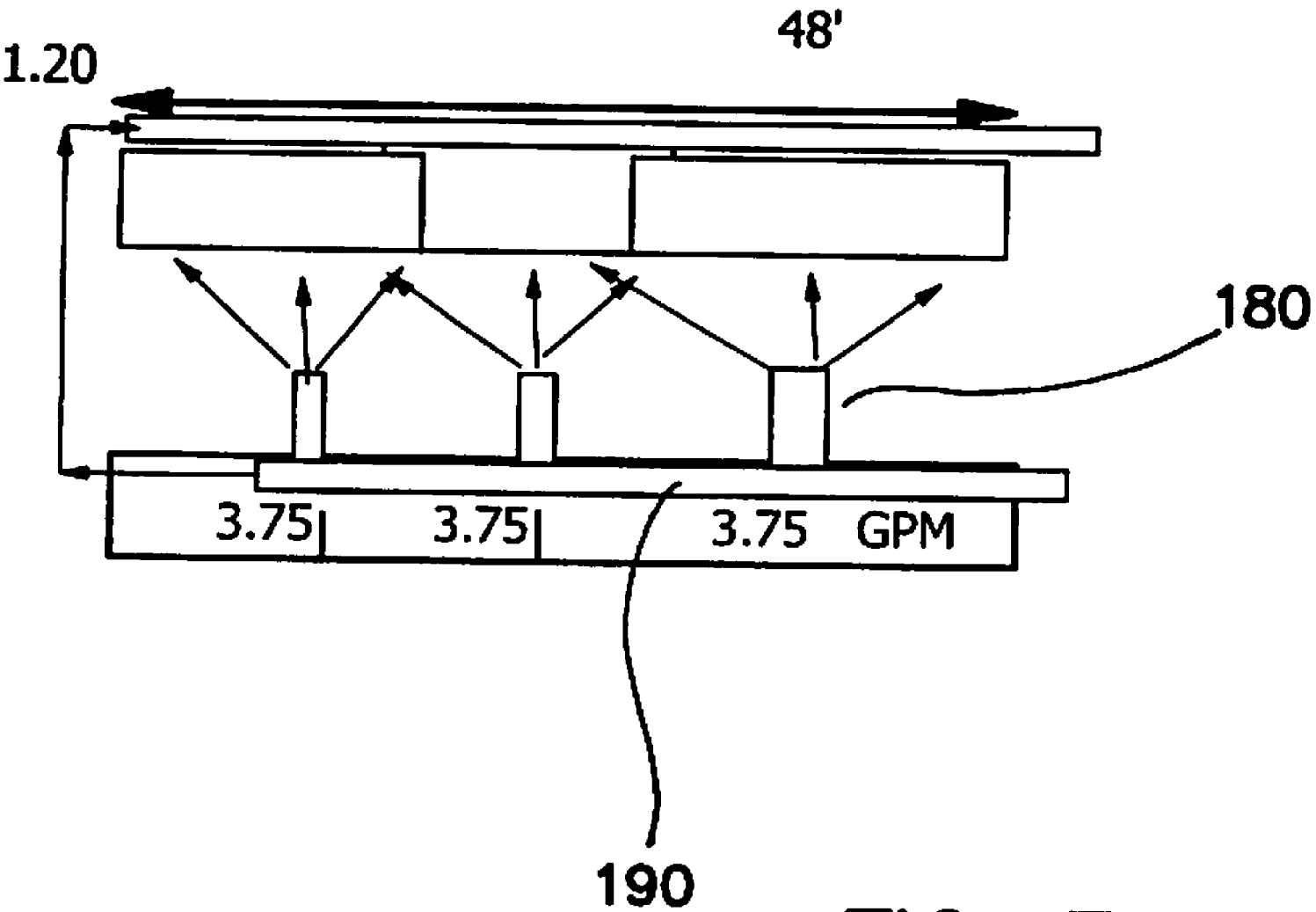
FIG. 7 illustrates a top block view of the arrangement between the spray nozzles and debris collection apparatus.

More particularly, during use, a water pump 150 draws water from compartments140-1 through 140-3 via tube, pipe or hose 160 and forces the water through tube, pipe or hose 170. The water exits hose 170 through a series of nozzles 180 (only one nozzle is visible in FIG. 1) positioned near, and directed into, the debris collection apparatus 130. The nozzles 180 increase the velocity and resultant pressure applied by the water such that the water is able to force debris into the debris collection apparatus 130. As shown in FIGS. 5-7, the series of spray nozzles 180 are spaced horizontally along a spray tube 190 to create a sufficiently wide path of operation. Water pump 150 forces the water through hose 170 into tube 190 and ultimately through the spaced spray nozzles 180. The hose 170 is connected to the tube 190 near a mid-point to provide for even distribution of water flow through the spaced nozzles 180. In one example, three nozzles 180 are spaced horizontally so that the nozzles 180 operate over a four foot wide path. The number and spacing of nozzles 180 may be increased or decreased depending on the subject cleaning task and the size of the vehicle accommodating the street sweeper system 100. One or more pressure gauges 185 may also be used at various locations along the water hoses or tubes to allow operators to assess the need for increasing or decreasing the water pressure and/or identifying problems with the system. Connecting the nozzles 180 to the spray tube 190 can be accomplished using any number of conventional means, included threaded connectors and the like. The nozzle and spray tube combination may also be fabricated as a single unit.

As shown in FIGS. 1-4, the debris collection apparatus 130 comprises a housing 200 for containing and protecting a series of brushes 210 attached to a shaft 220. FIGS. 2-5 show the debris collection apparatus 130 with a side exit channel 115 for accommodating a first end of the debris conduit 120 (not shown in FIGS. 2-5) extending along a side of the vehicle. The housing 200 defines a large opening for capturing debris therein. A hydraulic, electric, gas-powered or similar power source (not shown) drives shaft 220 and attached brushes 210.

Optionally, the debris collection apparatus 130 may include a hinged scoop 135 that contacts the subject street surface during operation. Hinge 138 connects the scoop 135 to the housing 200. In the event the surface topography changes, the attitude of the hinged scoop 135 changes automatically (i.e., adjusts about hinge 138) thereby maintaining contact with the street surface. Optional side walls 145 affixed to the debris collection apparatus 130 direct debris and water into the debris collection apparatus 130. The side walls 145 may automatically adjust in a vertical position by means of slidable rods 125. In this manner, as the side walls 145 encounter deviations in the street or road, the side walls 145 are able to adjust accordingly.

Figure 1A:
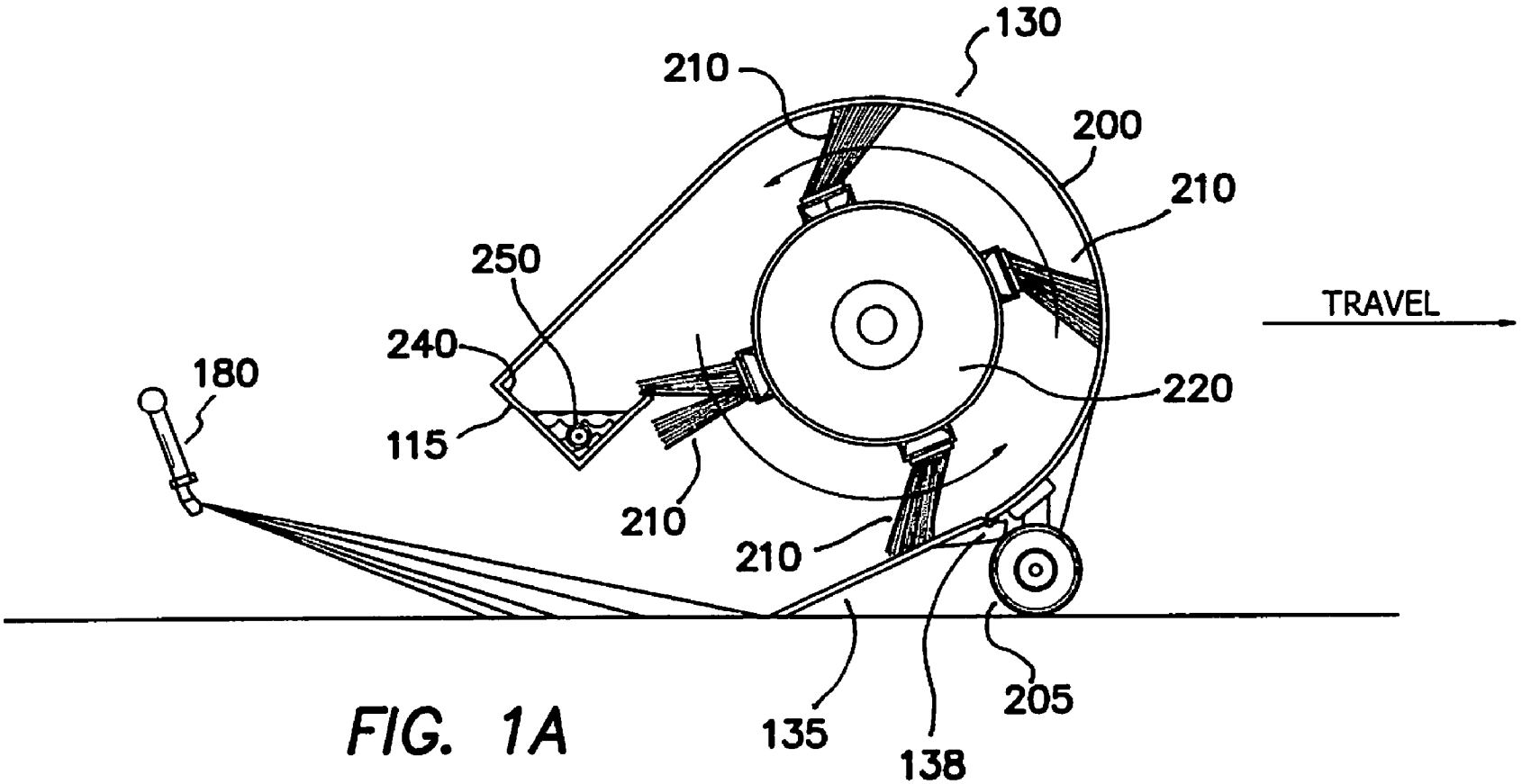
FIG. 1A illustrates a transparent, side view of a debris collection apparatus of the present invention.
Figure 2:
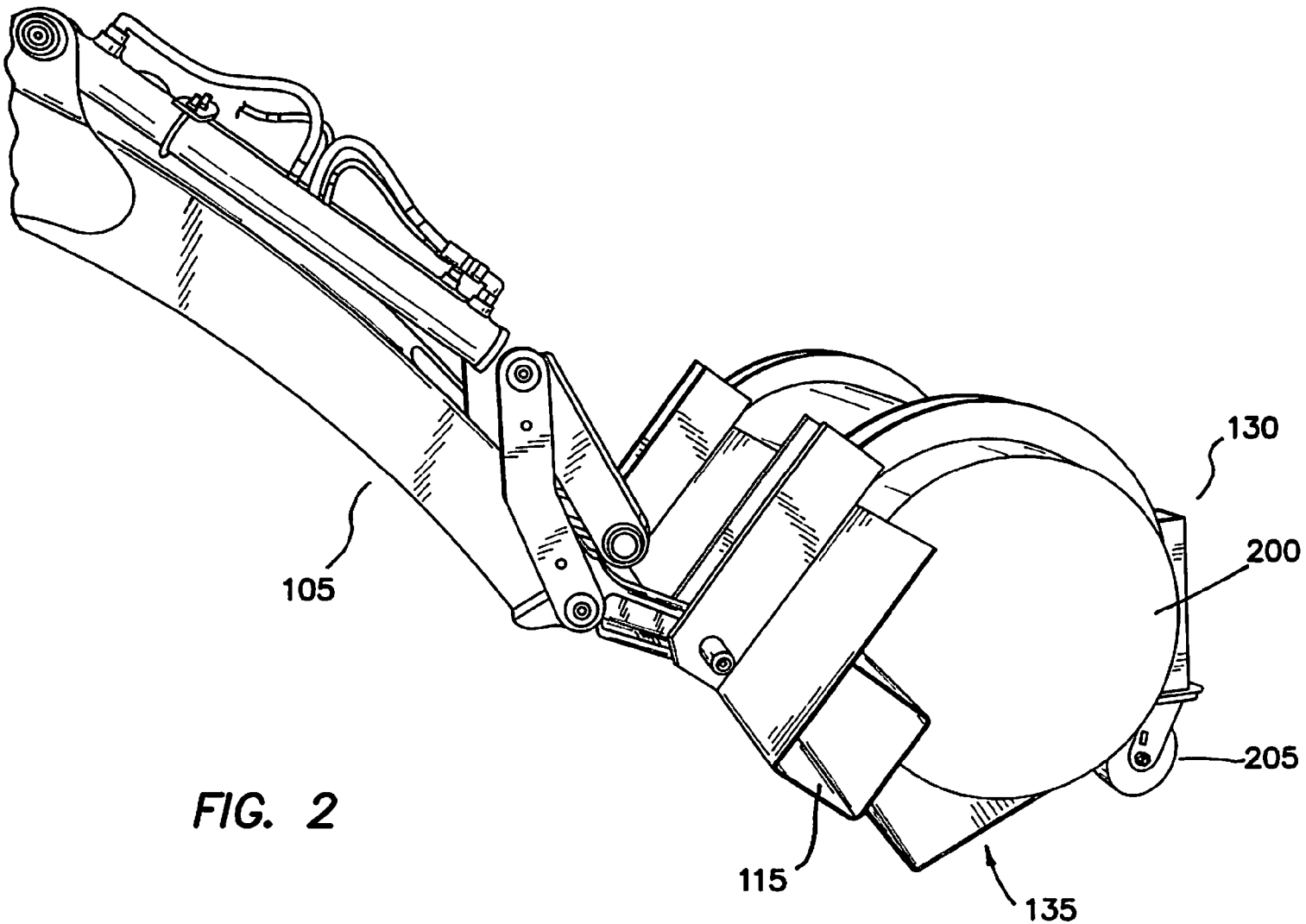
FIG. 2 illustrates a side view of a debris collection apparatus of the present invention.
Figure 3:
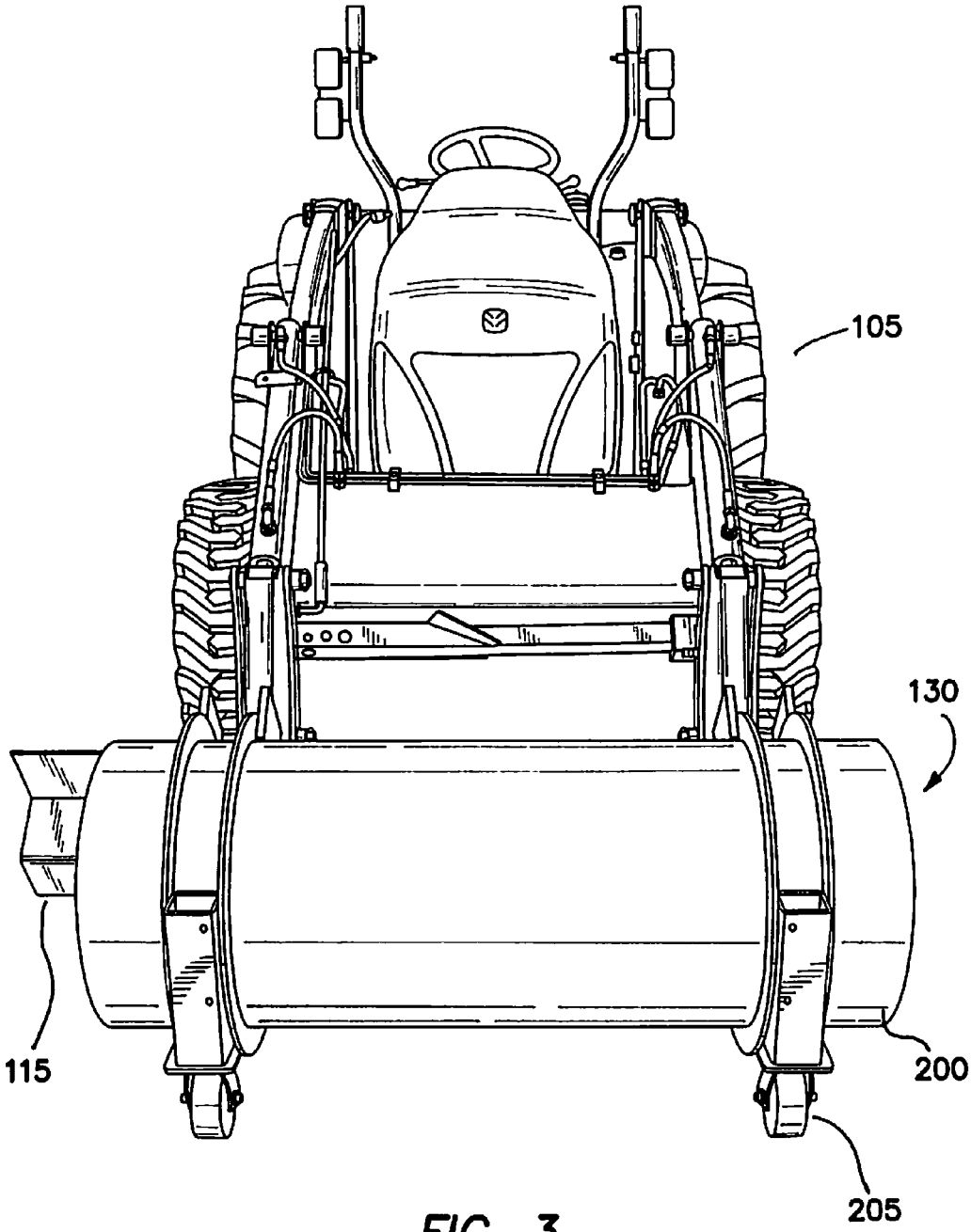
FIG. 3 illustrates a front view of the debris collection apparatus of the present invention.
Figure 4:
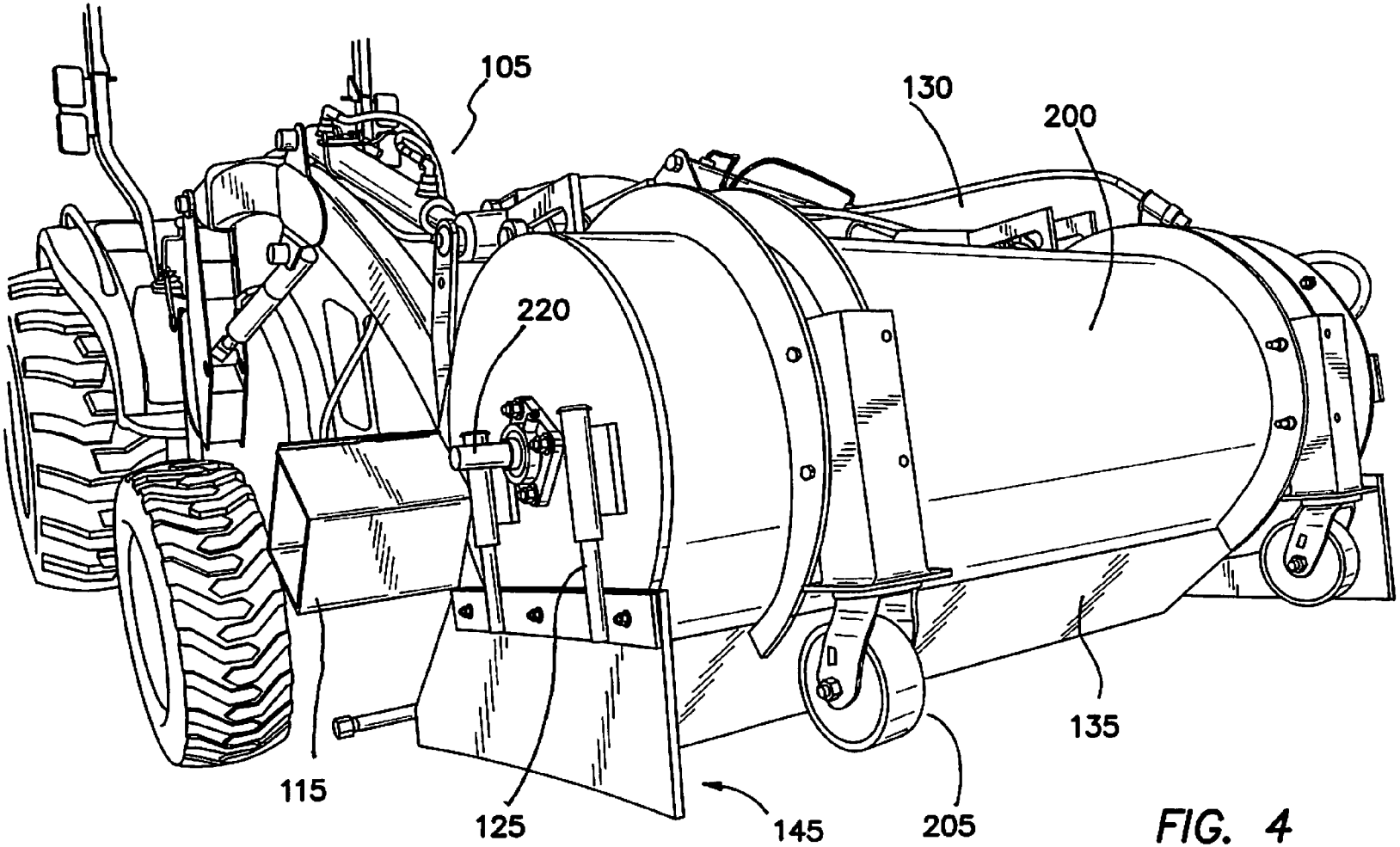
FIG. 4 illustrates perspective front view of the debris collection apparatus in a raised position.

During operation, as best seen in FIG. 1A, water exiting via spray nozzles 180 forces debris into the debris collection apparatus 130 and into the path of the rotating brushes 210. The brushes 210 rotate at approximately 40 to 50 RPM in the same direction as the water exiting nozzles 180 such that the brushes 210 propel the debris and collected water circumferentially through the housing 200 and into a discharge tray 240 extending along an internal width of the debris collection apparatus 130. As evident in FIGS. 1 and 1A, the brushes 210 do not make contact with the subject road or street surface during use but should make contact with an inner surface 230 of the housing 200. In this arrangement, unlike prior systems, the brushes do not agitate debris and dust on the road or street prior to collection. Moreover, the brush 210 contact with the inner surface 230 of the housing 200 maximizes the debris and water forced into the discharge tray 240. Ideally, the brushes 210 should have a length sufficient to contact the discharge tray 240 as they rotate. In this manner, collected debris and water is more likely than not to be collected in the discharge tray 240 and subsequently the debris conduit 120. The discharge tray 240 leads the debris and water to the exit channel 115 and into the debris conduit 120. One or more discharge nozzles 250 positioned horizontally within the housing 200, and adjacent and generally parallel to the discharge tray 240, discharge water (or air produced by a compressor) at high pressure to force the collected debris and water along the discharge tray 240 and toward an entrance 270 of the debris conduit 120.

In one embodiment, one or more high pressure orbital spray nozzles 260 positioned near the entrance 270 of the debris conduit 120 discharge water (or air) at high pressure forcing the debris through the debris conduit 120 and into the liquid and debris storage tank 110. Additional spray nozzles may be positioned intermittently along the length of the debris conduit 120 and directed to continuously force the debris along the debris conduit 120 and into the liquid and debris storage tank 110. Water pump 150 or additional water pumps (not shown) force water through pipes, tubes and hoses (not shown) to and through the nozzles 250 and 260.

The liquid and debris storage container 110 includes three partially separate compartments 140-1 through 140-3. Upper sections of the compartments 140-1 through 140-3 are open to one another. As described above, compartments 140-1 through 140-3 initially contain substantially clean water. Compartments 140-2 and 140-3 are configured to capture and retain contaminated water and debris, respectively. Collected debris and water exits the debris conduit 120 into compartment 140-3 through channel 155 that directs the debris and water near a bottom half of compartment 140-3. A vent 165 near an upper portion of channel 155 provides a passageway for water in the event debris and water block a lower portion of the channel 155. By discharging debris and water near a bottom half of compartment 140-3, the debris and smaller particulates are not overly agitated and smoothly flow into a flocculent that encourages the debris and particulates to settle at the bottom of the compartment 140-3. Collected water is retained in compartment 140-3 until the water rises to a level defined by barrier 145-2 separating compartment 140-3 from compartment 140-2. Once the level of the collected water reaches a top of the barrier 145-2 it flows over the barrier 145-2 and into compartment 140-2.

The collected water flowing into compartment 140-2 is ideally rid of larger debris and particulates, but likely remains dirty or contaminated. As additional water flows into compartment 140-2, debris and particulates settle on a bottom of the compartment 140-2. The water level in compartment 140-2 rises to a level whereby relatively clean water flows over barrier 145-1 and into compartment 140-1. Like compartment 140-1, compartment 140-2 may contain a flocculent to trap any additional debris and particulates not captured in compartment 140-3. The water that reaches compartment 140-1 is relatively free of debris and many of the original particulates. Accordingly, the water from compartment 140-1 is passed through a filter 285 (e.g., carbon or sand filter) and reused to collect debris from the subject surface. In this manner a large amount of the water may be used on several occasions during a cleaning operation.

The liquid and debris storage container 110 further includes a series of vents 175 integrated into an upper surface. The vents 175 are designed to release any gases which may accumulate in the liquid and debris storage container 110. Screw augers 280 are incorporated in, and extend across, a bottom surface 195 of compartments 140-2, 140-3. The augers 280 function to remove the settled debris and particulates from compartments 140-2, 140-3. Accessible openings (not shown) in compartments 140-2, 140-3 provide means for the debris and particulates to be transported by the augers 280 into a disposal unit, truck or similar device. One or more wheels 115 provide mobility to the storage container 110.

Figure 8:
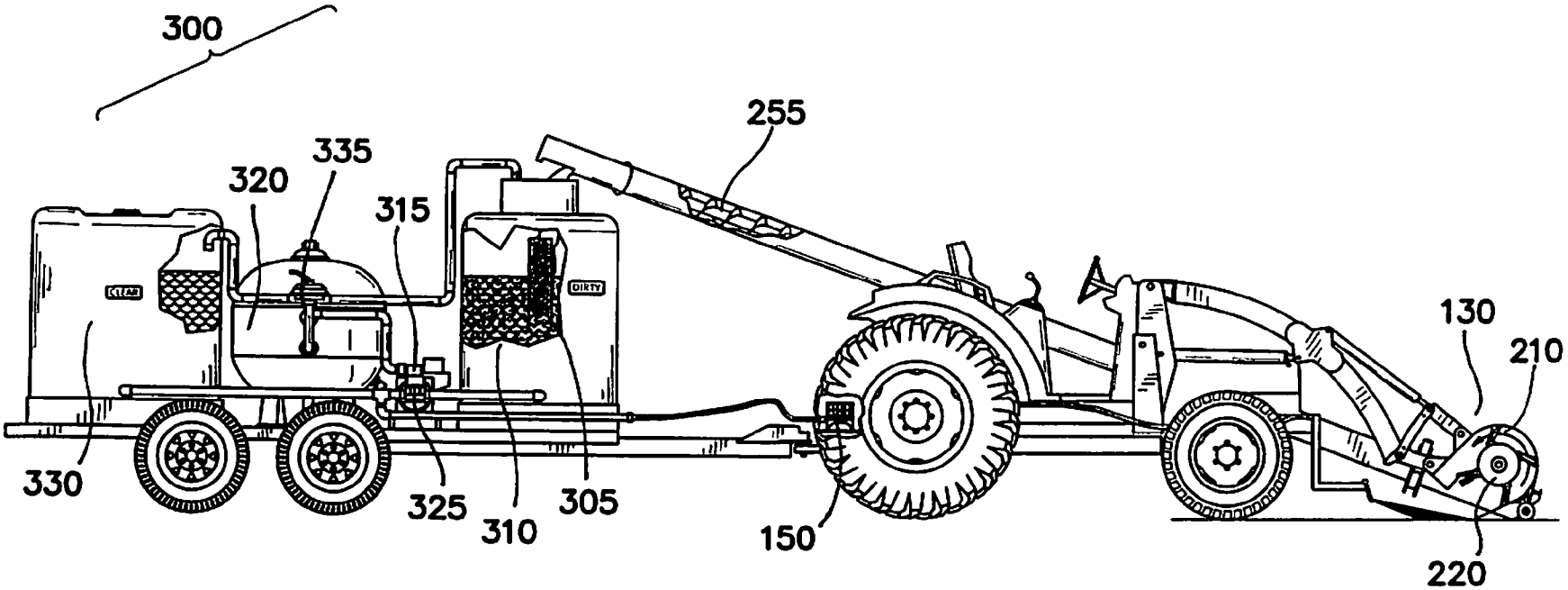
FIG. 8 illustrates a second embodiment of the present invention utilizing an auger to transport debris and water from the debris collection apparatus to a storage container having independent units.

In a second embodiment, as shown in FIG. 8, an auger 255 carries the debris and water from the debris collection apparatus 130 to a debris storage system 300. The auger 255 may be driven by the same power source (e.g., motor) driving the shaft 220 and attached brushes 210 or may rely on a separate power source. In one embodiment, the auger 255 is concealed in a tubular sleeve (not shown) that rotates with the auger 255. The tubular sleeve and auger 255 are then concealed with the debris conduit 120. The sleeve functions to maintain a path for the collected debris and water while ensuring the debris conduit 120 is not damaged by the auger 255.

FIG. 8 also shows an alternative water and debris storage system 300 comprising three independent and separate containers 310, 320 and 330. Container 310 receives the debris and water transported by auger 255. An intake filter 305 incorporated in container 310 catches large debris and release water and smaller debris. The dirty water from container 310 is pumped to the second container 320. Second container 320 is a sand filter that removes particulates from the dirty water. A Triton II sand filter is one example of a suitable sand filter. After passing through the sand filter 320, the clean water is pumped into container 330 and reused in the cleaning process. To facilitate the transfer of the water from container to container, the water and debris storage system 300 further incorporates an auxiliary pump 315, two-way valve 325 and back-flush valve 335.

As represented in the figures herein, the street sweeper system 100 is installed on a tractor 105. However, it will be understood by those skilled in the art that the street sweeper system 100 can be mounted on any suitable vehicle. Installing the street sweeper system 100 on a suitable vehicle is accomplished using conventional type connection means. Regardless of the type of transport vehicle, the vehicle operator may operate the street sweeper system 100 from a driver position in a closed or open vehicle cabin. A control panel (not shown) includes an on-off switch that causes the street sweeper system 100 to operate substantially as described herein. Operational parameters related to the water pumps, nozzles, collection apparatus brushes and augers may be individually controlled by the vehicle operator. The vehicle operator also controls the vertical position of the debris collection apparatus 130. During operation, the scoop 135 and defined opening of the debris collection apparatus 130 should be against the subject surface as near thereto as possible to ensure a maximum amount of debris and water is collected into the housing 200 of the debris collection apparatus 130. During non-operation, the debris collection apparatus 130 is maintained in an elevated position. With a tractor, the debris collection apparatus 130 is lifted akin to a conventional tractor scoop. A flexible hinge 215 integrated in the debris conduit 120 permits a lower portion 225 of the debris conduit 120 to move independently of an upper portion 235. A similar debris conduit 120 design may be used with a truck or other suitable vehicle. To accommodate the flexible hinge 215 in the debris conduit 120, the auger 255 may be formed of two separate members; a first member 215-1 in the lower portion 225 of the debris conduit 120 and a second member 215-2 in the upper portion 235 of the debris conduit 120.

The street sweeper system 100 of the embodiments of the present invention provide a thorough cleaning of a subject street or road surface while dramatically reducing the amount of consumed water. One embodiment of the present invention, having a four foot long spray tube 190, supporting three spray nozzles 180, is capable of cleaning a 60,000 square foot surface with 975 gallons of water. During the cleaning operation, only 97.5 gallons of water (i.e., 10% of the total water amount used) are lost such that 877 gallons are recovered during the operation. The recovered water can then be reused as described herein. Accordingly, a much larger area can be cleaned using a fixed amount of water.

Although the invention has been described in detail with reference to several embodiments, additional variations and modifications exist within the scope and spirit of the invention as described and defined in the following claims.

I claim:

1. A surface cleaning system comprising:

a storage system;

a debris collection apparatus having a housing containing a series of brushes, said housing comprising a circular cross-section for changing a direction of debris from forward to rearward;

a water pump operable to draw water from the storage system and discharge said water through one or more spray nozzles adjacent to, and directed into, the debris collection apparatus causing said discharged water to force debris into the debris collection apparatus, said debris collection apparatus positioned forward of said one or more spray nozzles with said one or more spray nozzles positioned to discharge water in a forward direction of travel of said surface cleaning system;

a debris conduit extending from near the collection apparatus to the storage container;

a drive means operable to rotatably drive the brushes about a horizontal axis such that collected debris and water is forced from the debris collection apparatus into the debris conduit, said brushes positioned such that said brushes contact an inner surface of the collection debris apparatus and not the ground; and one or more water spray nozzles and/or air spray nozzles operable to force the collected debris and water through the debris conduit and into the storage system.

2. The system of claim 1 wherein the storage system is a single unit comprising three partially separated compartments for separating and retaining water and debris.

3. The system of claim 1 wherein the storage system includes three separate units with a first unit operable to retain debris, a second unit operable as a sand filter and a third unit operable to retain clean water.

4. The system of claim 3 wherein the first unit includes a debris filter operable to separate debris from water.

5. The system of claim 1 further comprising one or more augers operable to remove debris from the storage system.

6. The system of claim 1 wherein the debris conduit includes a lower portion and upper portion defined by a flexible hinge.

7. The system of claim 1 wherein the debris collection apparatus includes a hinged scoop.

8. The system of claim 1 further comprising a side wall on each end of the debris collection apparatus.

9. The system of claim 1 further comprising multiple conduit spray nozzles positioned along a length of the debris conduit.

10. The system of claim 1 further comprising a discharge tray leading to an entrance of the debris conduit.

11. The system of claim 10 further comprising one or more spray nozzles operable to force debris and water along the discharge tray to an opening of the debris conduit.

12. The system of claim 1 configured for installation on a tractor or truck.

13. The system of claim 1 further comprising an air compressor.

14. A surface cleaning system comprising:

a compartmentalized storage container for retaining water and debris;

a debris collection apparatus housing a series of brushes mounted to a rotatable, horizontally positioned shaft, said housing comprising a circular cross-section for changing a direction of debris from forward to rearward, said brushes positioned such that said brushes contact an inner surface of the debris collection apparatus and not the ground;

a water pump operable to discharge water from the storage container through a series of spray nozzles directed into the debris collection apparatus wherein said discharged water forces debris into the debris collection apparatus, said debris collection apparatus positioned forward of said series of spray nozzles with said series of spray nozzles positioned to discharge water in a forward direction of travel of said surface cleaning system;

a debris conduit extending from near the collection apparatus to the storage container, said debris conduit having a lower portion and upper portion defined by a flexible hinge; and one or more water spray nozzles and/or air spray nozzles operable to force collected debris and water from said debris collection apparatus to said compartmentalized storage container.

15. The system of claim 14 wherein the storage container is a single unit comprising three partially separated compartments operable to separate water and debris.

16. The system of claim 14 wherein the storage container includes three separate units with a first unit operable to retain debris, a second unit operable as a sand filter and a third unit operable to hold clean water.

17. The system of claim 16 wherein the first unit includes a debris capturing device.

18. The system of claim 14 further comprising one or more augers operable to transfer debris from the storage container to a disposal unit.

19. The system of claim 14 wherein the debris collection apparatus includes a hinged scoop.

20. The system of claim 14 further comprising an adjustable side wall on each end of the debris collection apparatus.

21. The system of claim 14 further comprising multiple conduit spray nozzles positioned along a length of the debris conduit for forcing collected debris and water into said storage container.

22. The system of claim 14 further comprising a discharge tray positioned within the debris collection apparatus and extending to an opening of the debris conduit.

23. The system of claim 14 further comprising one or more spray nozzles for forcing debris and water to a debris conduit opening.

24. The system of claim 14 wherein the system is configured to be installed on a tractor or truck.

25. A surface cleaning system comprising:

a storage system;

a debris collection apparatus housing a series of rotatable brushes positioned such that said brushes contact an inner surface of the debris collection apparatus housing and not the ground, said housing comprising a circular cross-section for changing a direction of debris from forward to rearward;

a water pump operable to draw water from the storage system and discharge said water through one or more spray nozzles adjacent to, and directed into, the debris collection apparatus causing said discharged water to force debris into the debris collection apparatus, said debris collection apparatus positioned forward of said one or more spray nozzles with said spray nozzles positioned to discharge water in a forward direction of travel of said surface cleaning system;

a debris conduit extending from near the collection apparatus to the storage system;

a drive means operable to rotatably drive the brushes about a horizontal axis such that collected debris and water is forced from the debris collection apparatus into the debris conduit; and an auger operable to transport the collected debris and water through the debris conduit and into the storage system.

26. The system of claim 25 wherein the storage system is a single unit comprising three partially separated compartments operable to retain and separate water and debris.

27. The system of claim 25 wherein the storage system includes three separate units with a first unit operable to retain debris, a second unit operable as a sand filter and a third unit operable to retain clean water.

28. The system of claim 27 wherein the first unit includes a debris intake filter operable to separate debris from water.

29. The system of claim 25 further comprising one or more augers operable to remove debris from the storage system.

30. The system of claim 25 wherein the debris collection apparatus includes a hinged scoop.

31. The system of claim 25 further comprising adjustable side walls on each end of the debris collection apparatus.

32. The system of claim 25 further comprising a discharge tray leading to an entrance of the debris conduit.

33. The system of claim 25 further comprising one or more spray nozzles operable to force debris and water along the discharge tray to an opening of the debris conduit.

34. The system of claim 25 further comprising a sleeve encompassing the auger, said sleeve rotatable with said auger.

35. A method of cleaning a road or street surface comprising:

projecting water forward against a road surface using one or more spray nozzles such that debris is directed into a debris collection apparatus wherein said debris collection apparatus is positioned forward of said one or more spray nozzles and comprises a circular cross-section for changing a direction of debris from forward to rearward;

within the debris collection apparatus, rotating brushes about a horizontal axis in a direction corresponding to a direction of the projected water such that the debris, along with collected water, is forced adjacent to a first open end of a debris conduit wherein the debris conduit extends from the debris collection apparatus to a storage system, said brushes positioned such that said brushes contact an inner surface of the debris collection apparatus and not the ground; and forcing with one or more water spray nozzles and/or air spray nozzles and/or auger the debris and collected water from the first open end of the debris conduit through the debris conduit and into the storage system.

36. The method of claim 35 further comprising using an auger, one or more water spray nozzles and/or air spray nozzles to force the debris and collected water through the debris conduit and into the storage system.

37. The method of claim 35 further comprising separating debris and water into three separate compartments forming the storage system.

38. The method of claim 35 further comprising passing collected debris and water through a first storage system unit having a debris intake filter and a second storage system unit functioning as a sand filter, and collecting filtered water in a third storage system unit.

* * * * *